US006830148B2

(12) United States Patent
Glaser et al.

(10) Patent No.: US 6,830,148 B2
(45) Date of Patent: Dec. 14, 2004

(54) FREE-STANDING COMPACT GARMENT BAG

(76) Inventors: Myron Glaser, 383 A Lovell, Mill Valley, CA (US) 94941; Kari Glaser, 383 A Lovell, Mill Valley, CA (US) 94941

( * ) Notice: Subject to any disclaimer, the term of this patent is extended or adjusted under 35 U.S.C. 154(b) by 0 days.

(21) Appl. No.: 10/206,403

(22) Filed: Jul. 26, 2002

(65) Prior Publication Data

US 2004/0016657 A1 Jan. 29, 2004

(51) Int. Cl.[7] ..... B65D 85/18
(52) U.S. Cl. ..... 206/287.1; 190/13 R; 223/85
(58) Field of Search ..... 206/287.1, 289–291, 206/300; 383/22–24; D6/512–514; 223/97, 98, 87, 88, 94, 85, DIG. 3; 190/13 R, 115, 14, 103, 105, 107–110; 150/106, 111

(56) References Cited

U.S. PATENT DOCUMENTS 1,786,923 A * 12/1930 Scruby ..... 223/88
2,626,735 A * 1/1953 Gwinn et al. ..... 223/87
2,644,622 A * 7/1953 Gwinn et al. ..... 223/98
3,098,561 A * 7/1963 Kass ..... 206/287
3,542,170 A * 11/1970 Bialo ..... 206/279
3,746,222 A * 7/1973 Tiss ..... 223/87
3,958,675 A * 5/1976 Rosenblum ..... 206/287.1
4,693,368 A * 9/1987 King et al. ..... 206/287.1
4,854,431 A * 8/1989 Pulichino et al. ..... 190/108
D336,988 S * 7/1993 Wehrley ..... D3/278
5,388,734 A * 2/1995 Seitz ..... 223/98
5,509,588 A * 4/1996 Kimball ..... 223/98
5,857,597 A * 1/1999 Kolton ..... 223/85

* cited by examiner

*Primary Examiner*—Lien Ngo

(57) ABSTRACT

A compact, free-standing garment bag capable of being carried aboard commercial aircraft as carry-on baggage comprising a suit folder apparatus for hanging at least one suit wherein said suit folder apparatus is removable from the garment bag, an enclosure for receiving the suit folder apparatus wherein the apparatus is used to initiate at least two folds of the enclosure, and a compartment for receiving the folded enclosure.

21 Claims, 3 Drawing Sheets

FREE-STANDING COMPACT GARMENT BAG

BACKGROUND OF THE INVENTION

1. Field of the Invention

This invention relates generally to the field of luggage and traveling cases, and more particularly, to a compact garment bag.

2. Description of the Related Art

There exist a plethora of carrying cases designed for business travelers. They vary greatly in function, weight, size and choice of material. One such example is a garment bag, a relatively lightweight and soft carrying case designed for short business trips where the traveler typically packs along one or more business suits. While garment bags have thus become the carrying case of choice for short business trips, they are generally ill suited to the demands of most business travelers for several reasons.

First, today's garment bags are often too large to be carried aboard commercial aircraft. Commercial airlines require that carry-on baggage must be no larger than 55 cm×35 cm×25 cm (or approximately 22 in×14 in×9 in). Nevertheless, in an effort to eliminate the extra time required to check-in and subsequently retrieving checked-in baggage (and to a lesser extent, to eliminate the chance that checked-in baggage will be damaged and/or lost), many business travelers attempt to bring their garment bags onboard commercial aircraft as carry-on baggage. They are often frustrated to discover, however, that their garment bags cannot fit within the aircraft's overhead compartment and that the flight attendant will end up checking in the bag.

Second, many of today's garment bags are not freestanding. This shortcoming is evident to those business travelers who opt to check-in their garment bag. This is because causes these travelers must repeatedly reach down to pick up garment bags that have flopped over as they inch forward in the check-in line. At best, this repeated motion merely causes an added inconvenience. At worst, the traveler risks muscle strain and/or serious back injury. While this problem can be addressed by a rigid, internal structure, it is modern luggage designers have been unable to design a garment bag that is freestanding when fully packed without such internal supports.

Third, unless care is taken, clothes packed in today's garment bags can become so wrinkled that they inevitably require re-pressing upon arrival. While the wrinkling and crumpling of clothes is not unique to garment bags, the added time and expense required to re-press clothes upon arrival poses an additional inconvenience for today's harried business travelers.

What is needed is a soft case, compact garment bag that is freestanding when fully packed, that prevents and/or minimizes any wrinkling of the contents and, that easily fits within existing commercial aircraft overhead compartments.

SUMMARY OF THE INVENTION

The invention, roughly described, comprises a compact garment bag capable of being stored within the overhead compartment of commercial aircraft. The garment bag of the present invention comprises a removable suit folder apparatus for hanging at least one suit and an enclosure for receiving the apparatus wherein a first edge of the suit folder apparatus is used to initiate a first fold of the enclosure (and the suit within the enclosure) and a second edge of the suit folder apparatus is used to initiate a second fold of the enclosure. The first and second folds of the enclosure are both folded in a single direction towards a bottom portion of the enclosure. The suit folder apparatus comprises two horizontal slits each capable of receiving one or more pairs of slacks. A top portion of the suit folder apparatus comprises a sleeve into which a hanger mechanism can be inserted. The garment bag of the present invention further comprises a compartment for receiving the twice-folded enclosure. The compartment comprises a flap and at least one fastening means for securing the enclosure within the compartment.

In one aspect, the hanger mechanism and the suit folder apparatus are integrated into a single, contiguous device. In another aspect, the suit folder apparatus is constructed from a dimensionally stable and semi-deformable fabric. In another aspect, the suit folder apparatus is constructed from a rigid material.

DETAILED DESCRIPTION

Figure 1:
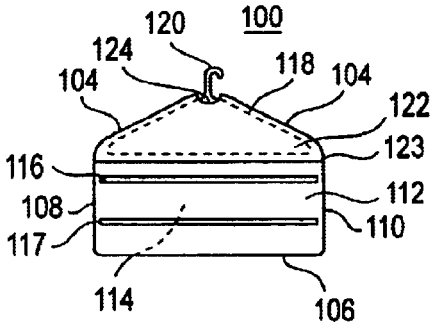
FIG. 1 illustrates a suit folder apparatus in accordance with the present invention.
Figure 1A:
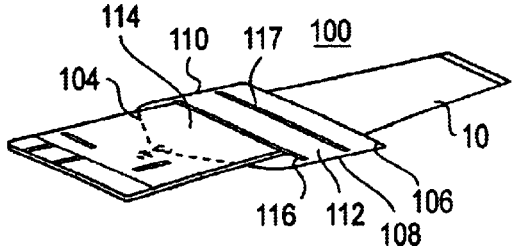
FIGS. 1A, 1B and 1C illustrate the use of the suit folder apparatus of FIG. 1.
Figure 1B:
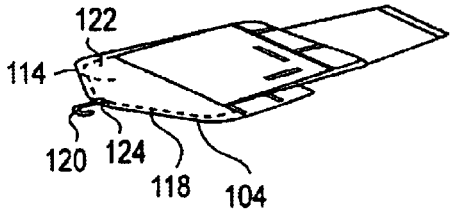

FIG. 1 illustrates a suit folder apparatus 100 in accordance with the present invention. Suit folder apparatus 100 comprises a top edge 104, a bottom edge 106, side edges 108 and 110, a front surface 112 and a rear surface 114 (not pictured), horizontal slits 116 and 117, and hanger mechanism 118. Slits 116 and 117 lie parallel to bottom edge 106, between side edges 106 and 108, and connect front surface 112 and rear surface 114 (not pictured). Slits 116 and 117 are located a first and second distance from bottom edge 106, respectively, and a third distance between side edges 108 and 110 (thereby defining a fixed length for slits 116 and 117). The length of slits 116 and 117 is designed so that each slit can receive at least one pair of slacks. FIG. 1A illustrates a single pair of slacks 10 inserted into slit 116. Slit 116 (and slit 117) is used to initiate a fold of the slacks inserted therein, as illustrated in FIG. 1B, such that the waistband rests substantially halfway between slits 116 and 117 and the cuffs of the respective slacks.

Suit folder apparatus 100 further comprises a sleeve 122 attached to top edge 104 and portions of side edges 108 and 110, on front surface 112, to form a horizontal opening 123 above and parallel to slit 116. It is through horizontal opening 123 that a hanger mechanism 118 having at least one hook member portion 120 can be inserted. Once inserted into sleeve 122, hanger mechanism 118 lies completely within sleeve 122 with the exception of hook member portion 120. Hanger mechanism 118, as inserted into sleeve 122, lends suit folder apparatus greater structural rigidity.

Hook member portion 120 of hanger mechanism 118 extends through a semi-circular opening 124 in sleeve 122 and protrudes above top edge 104 of suit folder apparatus 100. Hook member portion 120 can be used to hang suit folder apparatus 100 and any suit jackets or slacks hung thereon in, for example, a closet in the same fashion as one would use a traditional coat hanger.

Figure 1C:
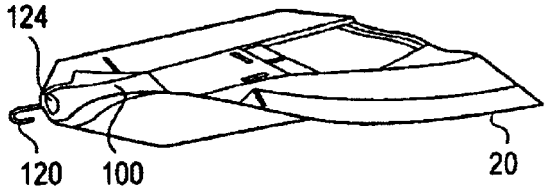

In one aspect of the present invention, the edges of sleeve 122 are sewed onto top edge 104 and portions of side edges 108 and 110. In another aspect of the present invention, sleeve 122 is an integral part of suit folder apparatus 100. In another aspect of the present invention, sleeve 122 is attached to top edge 104 and portions of side edges 108 and 110 using Velcro™ straps. In another aspect of the present invention, hanger mechanism 118 can be a traditional coat hanger capable of hanging a suit jacket 20 as shown in FIG. 1C. In another aspect, hanger mechanism 118 and suit folder apparatus 100 are integrated into a single (contiguous) device or component, in which case sleeve 122 may not be needed. In another aspect of the present invention, hanger mechanism 118 can alternatively be a custom-designed coat hanger having single hook portion and multiple shoulder sections, each shoulder section being capable of hanging one or more suit jackets. In yet another aspect of the present invention, hanger mechanism 118 can alternatively be a custom-designed, monolithic coat hanger having multiple hook portions and multiple shoulder sections, where each shoulder section is capable of hanging one or more suit jackets. Hanging mechanism 118 can be constructed of various materials including, but not limited to, plastic, metal, wood, or other composite material.

In one aspect of the present invention, suit folder apparatus 100 is composed of a dimensionally stable, deformable material such as closed-cell foam. In another aspect of the present invention, suit folder apparatus 100 is composed of a rigid material such as Plexiglas™. In various other aspects of the present invention, suit folder apparatus 100 can be constructed from materials including polyethylene, Styrofoam™, polypropylene, polycarbonate, or ABS material (this list is illustrative rather than comprehensive). In another aspect of the present invention, suit folder apparatus 100 can be constructed from various combinations of the aforementioned materials. In another aspect of the present invention, suit folder apparatus 100 does not contain a sleeve 122 into which a hanger mechanism 118 is inserted. Rather, in this aspect of the invention, suit folder apparatus 100 and hanger mechanism 118 are one and the same such that hook member portion 120 is a continuous extension of top edge 104. In another aspect of the present invention, top edge 104 of suit folder apparatus 100 comprises a first portion 126 adjoining hook member portion 120 and a second portion 128 where the width of first portion 126 is less than or equal to the width of second portion 128.

Figure 2A:
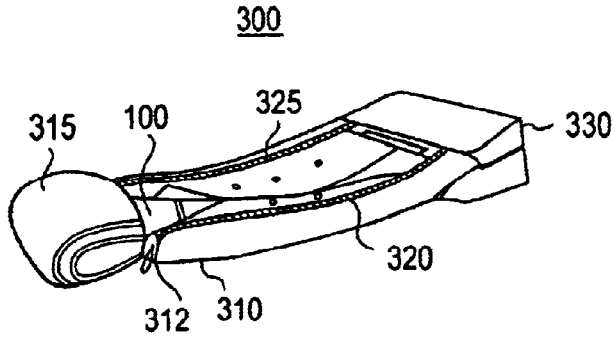
FIG. 2A illustrates an enclosure to receive the suit folder apparatus of FIG. 1 in an open position.
Figure 2B:
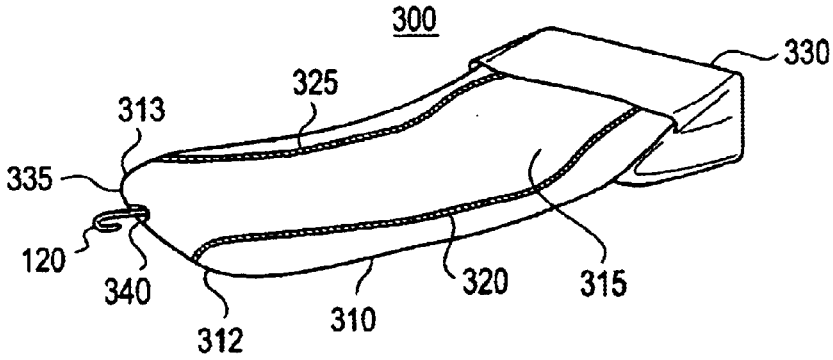
FIG. 2B illustrates the enclosure of FIG. 2A in a closed position.

FIG. 2A illustrates a compact garment bag 300 in accordance with the present invention. Garment bag 300 comprises an enclosure 310 for receiving suit folder apparatus 100 into whose horizontal slits 116 or 117 at least one pair of slacks 10 has been inserted, and onto whose top edge 104 at least one suit jacket 20 has been hung. Enclosure 310 comprises an enclosure flap 315 and fastener means 320 and 325 located parallel to one another along the length of enclosure 310. As illustrated in FIGS. 2A and 2B, fastener means 320 and 325 are zippers but they can also comprise buttons, Velcro straps, or other such fastener means. The length of enclosure 310 is at least as long as the length of one suit jacket 20 that has been hung onto suit folder apparatus 100. In a first, open position, fastener means 320 and 325 allow enclosure flap 315 to be opened and pulled away from enclosure 310 thereby creating a space into which slacks and jackets hung onto suit folder apparatus 100 can be inserted.

FIG. 2B illustrates a second, closed position of enclosure 310, where enclosure flap 315 has been returned to its original position and fastener means 320 and 325 have been closed. FIG. 2B also illustrates an opening 340 into which hook member portion 120 (of hanger mechanism 118 of suit folder apparatus 100) has been inserted and from which hook member portion 120 protrudes. Not pictured in FIG. 2B are the slacks 10 and suit jacket 20, respectively, which have been inserted into and hung on suit folder apparatus 100. In one aspect of the present invention, fastener means 320 and 325 are zippers. In other aspects of the present invention, fastener means 320 and 325 range from Velcro™ straps, to snaps, to buttons. In another aspect of the present invention, fastener means 320 and 325 can comprise any combination of the foregoing means. In yet another aspect of the present invention, enclosure 310 comprises only one fastener means, which can be either a zipper or a Velcro™ strap.

Figure 2C:
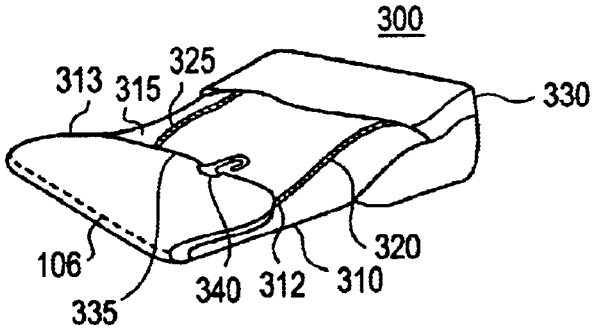
FIG. 2C illustrates the enclosure of FIG. 2A in a first, folded position.

FIG. 2C illustrates enclosure 310 in a first folded position. Slacks 10 and suit jacket 20 have been hung on suit folder apparatus 100 (not pictured because fastener means 320 and 325 are in the closed position), and the resulting ensemble have been inserted into enclosure 310 such that hook member portion 120 of hanger mechanism 118 protrudes from opening 340 and top edge 104 of suit folder apparatus 100 abuts the interior of the top portion 335 of enclosure 310. FIG. 2C also illustrates how bottom edge 106 of suit folder apparatus 100 is used to initiate a first fold of enclosure 310. In one aspect of the present invention, hook member portion 120 is then used to initiate a second fold of enclosure 310. In another aspect of the present invention, hook member portion 120 is pushed back through opening 340 and a second fold of enclosure 310 is initiated by top edge 104 of suit folder apparatus 100. There are several reasons for folding enclosure 310 at least twice.

First, folding enclosure 310 twice obviously reduces its size and thus reduces the size of a compartment 410 required to accommodate a twice-folded enclosure 310 (as opposed to an enclosure that is folded only once). This, in turn, reduces the size of the garment bag of the present invention and, given a judicious choice of the dimensions of enclosure 310, makes it possible for the garment bag to fit within the overhead compartments of today's commercial aircraft. Ultimately, this enables a full-sized garment bag in accordance with the present invention to be carried aboard aircraft as carry-on baggage.

Second, by folding enclosure 310 as if it were being rolled (with both the first and second folds of enclosure 310 being folded in the same direction toward a bottom portion of enclosure 310 or a base portion 330 of garment bag 300), there will be less shifting of the garments, less friction between garments and, ultimately, less wrinkling of the garments. This "roll-fold" is also advantageous since it allows garment bag 300 to be carried by a single handle 560 at a top portion 550 (See FIG. 3B) of garment bag 300.

Figure 3A:
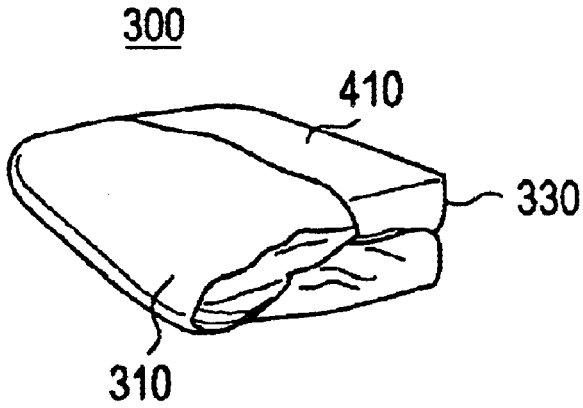
FIG. 3A illustrates the enclosure of FIG. 2A in a second, folded position.
Figure 3B:
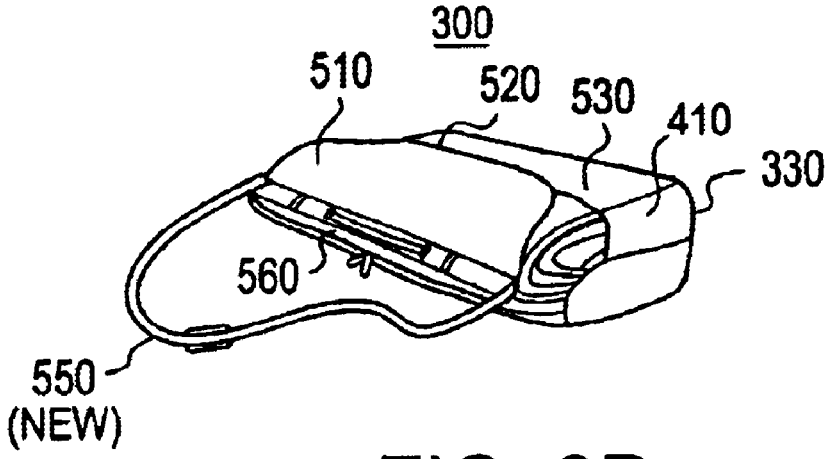
FIG. 3B illustrates the twice-folded enclosure of FIG. 3A inserted into a compartment suitably sized to receive the twice-folded enclosure.

FIG. 3A illustrates a twice-folded enclosure 310 that is now ready to be inserted into compartment 410. In accordance with the present invention, twice-folded enclosure 310 is then completely inserted into compartment 410, as illustrated in FIG. 3B, and a flap 510 is then closed to completely cover enclosure 310. In one aspect, compartment 410 is sized to simultaneously accommodate twice-folded enclosure 310 and a separate, removable container for packing other clothes (e.g., shirts, underwear, socks, etc..). Flap 510 is then secured to the exterior of compartment 410 using one or more fasteners 520 and 530. While fasteners 520 and 530, as shown, are snaps, compartment 410 can be closed and secured using buttons, zippers, Velcro™ straps, other such fastening means or any combination of these fastening means. Folding enclosure 310 containing at least one suit ensures that, when inserted into compartment 410, the garment bag of the present invention has sufficient structural support to be completely free-standing. In one aspect, the garment bag of the present invention only accommodates one suit. In another aspect, more than one suit can be packed within the garment bag of the present invention using a single suit folder apparatus 100.

The foregoing detailed description of the invention has been presented for purposes of illustration and description. It is not intended to be exhaustive or to limit the invention to the precise form disclosed, and obviously many modifications and variations are possible in light of the above teaching. The described embodiments were chosen in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A free-standing, compact garment bag capable of being stored within an overhead compartment of commercial aircraft, comprising:

a suit folder apparatus in a top portion of the enclosure for hanging garments thereon;

an enclosure for receiving said suit folder apparatus, wherein a bottom edge of said suit folder apparatus is used to initiate a first of at least two folds of said enclosure; and a compartment for receiving and securing said enclosure, wherein a bottom portion of said enclosure is attached to an interior surface of said compartment.

2. The garment bag of claim 1, wherein said suit folder apparatus comprises a top edge, a bottom edge, side edges, a front surface, a back surface and at least one horizontal slit connecting said front and back surfaces, said slit being parallel to said top and bottom edges and between said side edges.

3. The garment bag of claim 2, further comprising a hanger mechanism having a hook member portion, said hanger mechanism being a contiguous part of said suit folder apparatus.

4. The garment bag of claim 2, further comprising a hanger mechanism having a hook member portion, said hanger mechanism capable of being inserted into a first opening in a sleeve attached to said front surface of said suit folder apparatus above said slit wherein said hook member portion protrudes through a second opening in said sleeve, said second opening being adjacent to said top edge of said suit folder apparatus and opposite to said first opening.

5. The garment bag of claim 4, wherein said enclosure further comprises an opening through which said hook member portion of said hanger mechanism is inserted.

6. The garment bag of claim 3, wherein said top edge and said hook member portion of said suit folder apparatus initiates a second fold of said enclosure.

7. The garment bag of claim 1, wherein said suit folder apparatus is constructed from a semi-deformable material.

8. The garment bag of claim 1, wherein said enclosure and said compartment comprises at least one fastening means for closing said enclosure and compartment, respectively.

9. The garment bag of claim 1, wherein the dimensions of said garment bag are substantially no larger than 22 inches by 14 inches by 9 inches.

10. The garment bag of claim 1, wherein all folds of said enclosure are folded in a single direction towards a base portion of said garment bag.

11. The garment bag of claim 1, wherein said compartment is sized to receive said folded enclosure.

12. The garment bag of claim 1, further comprising at least one carrying means for transporting said garment bag.

13. The garment bag of claim 12, wherein said carrying means comprises a handle attached to a top portion of said garment bag.

14. The garment bag of claim 12, wherein said carrying means comprises a handle, said handle being attached to a middle section of a top portion of said garment bag.

15. A suit folder apparatus for initiating at least two folds of a suit jacket and slacks hung thereon inside an enclosure, comprising:

at least two horizontal slits, said slits being parallel to a top and bottom edge of said suit folder apparatus and situated between side edges of said suit folder apparatus, wherein each of said slits connects exterior front and rear surfaces of said suit folder apparatus and is capable of receiving said slacks therethrough; and a sleeve attached to the top edge and portions of the side edges and on the front surface, to form a horizontal opening above and parallel the slits.

16. The suit folder apparatus of claim 15, further comprising a hanger mechanism having at least one hook member portion and at least one shoulder portion wherein corresponding shoulder portions of said suit jacket can be hung.

17. The suit folder apparatus of claim 16, wherein said hanger mechanism is inserted in said horizontal opening in said sleeve, wherein said book member portion protrudes from a second opening in said sleeve, said second opening being opposite to said horizontal opening in said sleeve.

18. The suit folder apparatus of claim 15, wherein said sleeve is removably attached from said front surface of said suit folder apparatus.

19. The suit folder apparatus of claim 18, wherein said hanger mechanism and said suit folder apparatus are integrated into a single, contiguous device.

20. The suit folder apparatus of claim 15, wherein said apparatus is constructed from a semi-deformable material.

21. The suit folder apparatus of claim 16, wherein said hanger mechanism is constructed from a rigid material.

* * * * *